United States Patent [19]

Zavitsanos et al.

[11] 4,076,563

[45] Feb. 28, 1978

[54] EXPLOSIVE COMPOSITION FOR HIGH TEMPERATURE APPLICATIONS

[75] Inventors: Peter D. Zavitsanos, Norristown; Martin M. West, Philadelphia; William G. Browne, Gladwyne, all of Pa.

[73] Assignee: General Electric Company, Philadelphia, Pa.

[21] Appl. No.: 633,244

[22] Filed: Nov. 19, 1975

[51] Int. Cl.[2] ..... C06B 33/00

[52] U.S. Cl. ..... 149/37; 75/84

[58] Field of Search ..... 149/37; 75/84

[56] References Cited

U.S. PATENT DOCUMENTS

| | | | |
|---|---|---|---|
| 3,297,503 | 1/1967 | Hoffman et al. | 149/37 X |
| 3,703,144 | 11/1972 | Colburn | 149/37 X |

*Primary Examiner*—Stephen J. Lechert, Jr.

*Attorney, Agent, or Firm*—Johnson, Jr. James W.

[57] ABSTRACT

An explosive composition for high temperature applications comprises the reactant thorium and molybdenum trioxide. This composition when reacted liberates great amounts of thermal energy at extremely high temperatures in excess of 4000° K forming reaction products of thorium dioxide and molybdenum.

3 Claims, No Drawings

EXPLOSIVE COMPOSITION FOR HIGH TEMPERATURE APPLICATIONS

BACKGROUND OF THE INVENTION

1. Field of the Invention

This invention relates to an explosive mixture.

2. Description of the Prior Art

In the international family of nations, great concern about the effects of nuclear explosions has been shown. For example, various governmental agencies of the United States are concerned with the effects of nuclear explosions with respect to the release of refractory metal vapors, such as uranium, Fe and Al into the earth's atmosphere. In general, concern has also been shown with the effects of nuclear explosions upon the earth's environment and inhabitants, and with the amount of heat and illumination emitted by nuclear explosions.

One method of determining the effects of nuclear explosions is to employ sensor type instruments to indicate the crucial property characteristics of nuclear explosions. The sensors (because of the importance of correctly ascertaining the characteristics of the nuclear explosions) must supply accurate and true information, and thus must be critically calibrated and/or adjusted.

Unfortunately, however, it is extremely difficult to prepare an explosive mixture that may duplicate, partially or wholly, the thermal effects of nuclear explosions so that the sensors may be tested for sensor accuracy under conditions that approximate an actual nuclear explosion.

Thus, it is an object of this invention to provide an explosive composition that may simulate the thermal effects of an actual nuclear explosion.

Another object of this invention is to provide an explosive composition that liberates high amounts of thermal energy at extremely high temperatures.

Still, another object of this invention is to provide a thermal source for releasing refractory metal vapors.

Yet, another object of this invention is to provide a high intensity source useful in illuminant applications.

A further object of this invention is to provide a high density explosive composition useful in non-nuclear applications.

It is still a further object of this invention to provide an explosive composition which may be used for imparting great amounts of heat.

SUMMARY OF THE INVENTION

The elements thorium and molybdenum trioxide are utilized to prepare an explosive mixture, which mixture reacts in accordance with the following thermochemical equation:

$$Th + 2/3\ MoO_3 \rightarrow ThO_2 + 2/3\ Mo$$

In the above reaction, great amounts of thermal energy at temperatures in excess of 4000° K is liberated upon forming reaction products of thorium dioxide and molybdenum.

DETAILED DESCRIPTION OF THE INVENTION

A high explosive composition is prepared or synthesized by preparing a mixture comprising the reactants thorium metal and molybdenum trioxide. The average diameter of the particle size of the reactants can be in a range between 50 to 100 microns.

Initiation of a thermochemical reaction between the above reactants is accomplished in numerous ways, such as: (a) a wire of high resistance electrically heated to a temperature of about 1000° K, (b) by an open flame, or (c) commercially available initiators, such as pyrotechnics or squibs. The reaction occurs in either vacuum and air environments and the reaction chamber may be comprised of tantalum or zirconia.

The reaction proceeds in the following manner:

$$Th + 2/3\ MoO_3 \rightarrow ThO_2 + Mo$$

In the above reaction, high amounts of heat energy are generated in a temperature range in excess of 4000° K upon forming the reactant products of thorium dioxide plus molybdenum metal. The products are removed from the reaction chamber in the form of liquid particles radiating illumination and heat.

It was found that the temperature measured in the reaction chamber environment using an ircon optical pyrometer (operating in the 2–3 micrometer range) was in excess of 4000° K. The first law of thermodynamics can be applied to this reaction system yields an adiabatic reaction temperature in excess of 4000° K.

Table 1 shows a molecular structure and energy levels for thorium and thorium compounds used in the first law of thermodynamic computations.

TABLE 1

MOLECULAR STRUCTURE AND ENERGY LEVELS FOR THORIUM AND THORIUM COMPOUNDS

| Species | Heat of Formation at 0° K | Rotational Constant | Moments of Inertia | Vibrational Frequency | Electronic Energy (relative to ground state) | Statistical Weight |
|---|---|---|---|---|---|---|
| | $\Delta H_{f_0}$ kcal/mole | Be ($cm^{-1}$) | $I_A I_B I_C$ ($g^3 cm^6$) | $\omega_e$ ($cm^{-1}$) | ($cm^{-1}$) | (ground state) |
| Th(g) | 142.8 | | Used atomic energy levels for Zr | | | |
| ThO(g) | 5.5 | 0.33199 | | 890.99 | 0 | 5 |
| | | | Plus 19 excited electronic states based on $Th^{2+}$ levels | | | |
| $ThO_2$(g) | −112.5 | | $9.433 \times 10^{-115}$ | 786.8<br>81<br>734.5 | 0 | 1 |

Table 2, which follows, illustrates the equilibrium composition and enthalpy of combustion products for the thorium plus molybdenum trioxide reaction system at atmospheric pressure.

TABLE 2

EQUILIBRIUM COMPOSITION AND ENTHALPY OF COMBUSTION PRODUCTS OF Th/MoO3 SYSTEM

| Reactants at 298° K | Products at 1 atm., flame temperature T° K |
|---|---|
| 0.999 Th (s) + 2/3 MoO3 (s)→ | [$ThO_2$ (l), Mo (l), $ThO_2$, |

TABLE 2-continued

| | ThO(g), Th(g), $MoO_2$(g), MoO(g), Mo(g), $O_2$, O] | |
|---|---|---|
| Reactants = −357.6 cal/g (abslute enthalpy) | | |
| X(mol fraction) | 3800° K | 4000° K |
| $ThO_2$ (1) | 802. | 650. |
| Mo (1) | 535. | 434. |
| $ThO_2$ | 0.100 | 0.252 |
| ThO | 0.001 | 0.007 |
| Th | $1.5 \times 10^{-8}$ | $2.2 \times 10^{-7}$ |
| $MoO_2$ | 0.702 | 0.517 |
| MoO | 0.026 | 0.037 |
| Mo | 0.016 | 0.037 |
| $O_2$ | 0.019 | 0.018 |
| O | 0.137 | 0.200 |
| h | −555. | −540. |
| M | $2.63 \times 10^5$ | $2.13 \times 10^5$ |

X = molfraction, mols/mole of gas phase only
h = enthalpy, cal/g mixture
M = molecular mass, g mixture/mole of gas only
The adiabatic reaction temperature is in excess of 4000° K, and is the temperature where the enthalpy of the products equals the enthalpy of the reactants.

The results of Tables 1 and 2 illustrate the following two principal points: one, that a high explosive mixture comprising thorium and molybdenum trioxide is capable of generating temperatures in excess of 4000° K and two, that at temperatures of 4000° K, the reactant products are extremely refractory, and are essentially in a condensed phase because an insignificant amount of vaporization takes place.

Because of the above two properties, the highly reactive mixture has enormous utility in a broad range of beneficial and useful applications. For example, high temperatures may be generated and used to vaporize certain refractory metal powders, which are added to the mixture and which cannot otherwise be vaporized through chemical means. Examples of some of these added metals are uranium, iron and aluminum. The normal boiling points of the above metal are as follows:

a. uranium 4090° K
b. iron 3138° K
c. aluminum 2736° K

Additional alkaline metals which may be vaporized are lithium, sodium, potassium rubidium, and cesium. There is sufficient energy in the Th + $MoO_3$ composition to vaporize any one of these metals.

Further, thermal simulation of nuclear explosions is possible by vaporizing the above refractory metals and releasing them into the atmosphere, through which accuracy of sensor testing instruments may be evaluated. The explosive mixture has utility in illuminant applications, such as: high temperature sources, calibration sources, radiation sources and high intensity lighting applications, to name only a few; and the mixture is also useful in high density explosive applications. As an illustration, the stoichiometric mixture of (1 Th + 2/3 $MoO_3$), also shown at Table 2, has a theoretical density of 8.8 g/cc.

It will be apparent that it is possible to produce other embodiments of an explosive combustion or a process for a high temperature explosion without departing from the scope of the inventive concept herein disclosed, and that all the matter contained in the above description should be interpreted as illustrative and not in a limiting sense.

What is claimed and desired to be secured by Letters Patent of the United States is:

1. An explosive composition, which comprises thorium and molybdenum trioxide.

2. The reactive composition recited in claim 1 further including a refractory metal powder.

3. The explosive composition recited in claim 2 wherein said refractory metal powder is selected from the group consisting of uranium, iron, aluminum, lithium, sodium, potassium, rubidium, and cesiun.

* * * * *